United States Patent [19]

Marietta

[11] Patent Number: 4,638,886

[45] Date of Patent: Jan. 27, 1987

[54] APPARATUS FOR DISABLING AN OBSTRUCTED LIFT MECHANISM

[75] Inventor: Walter E. Marietta, Racine, Wis.

[73] Assignee: Sta-Rite Industries, Inc., Milwaukee, Wis.

[21] Appl. No.: 789,516

[22] Filed: Oct. 21, 1985

[51] Int. Cl.[4] ..... B66F 7/16; F15B 13/07

[52] U.S. Cl. ..... 187/8.49; 187/8.5; 187/17; 254/89 H; 91/517; 91/445

[58] Field of Search ..... 187/8.41, 8.47, 8.49, 187/8.5, 9 R, 9 E, 17; 254/89 H; 91/517, 520, 445

[56] References Cited

U.S. PATENT DOCUMENTS

| | | | |
|---|---|---|---|
| 2,144,892 | 1/1939 | Parker | 91/517 X |
| 2,698,517 | 1/1955 | Witt | 91/517 X |
| 3,960,286 | 6/1976 | Spooner et al. | 414/635 |
| 4,457,401 | 7/1984 | Taylor et al. | 187/8.49 |
| 4,567,727 | 2/1986 | Grams | 91/520 X |
| 4,573,663 | 3/1986 | Nussbaum | 254/89 H |

FOREIGN PATENT DOCUMENTS

| | | | |
|---|---|---|---|
| 2752555 | 6/1978 | Fed. Rep. of Germany | 254/89 H |

*Primary Examiner*—Joseph J. Rolla
*Assistant Examiner*—Nils E. Pedersen
*Attorney, Agent, or Firm*—Larry L. Shupe

[57] ABSTRACT

An apparatus for disabling an obstructed lift mechanism having at least two hydraulic cylinders for controllably lifting and lowering a load includes a pair of valves, each arranged for sensing the differential pressure between a first sensing line and a second sensing line. The first valve is movable to a position for preventing the flow of hydraulic fluid from a first cylinder when the pressure in the second sensing line exceeds that in the first sensing line by a first predetermined value. The second value is movable to a position for preventing the flow of hydraulic fluid from the first cylinder when the pressure in the first sensing line exceeds that in the second sensing line by a second predetermined value. If the flow of hydraulic fluid from the first cylinder is prevented by the movement of either the first valve or the second valve, the operator is required to lift the load slightly to remove the obstruction.

9 Claims, 7 Drawing Figures

APPARATUS FOR DISABLING AN OBSTRUCTED LIFT MECHANISM

This invention relates generally to hydraulic control circuits for controllably lifting and lowering a load and more particularly, to a circuit apparatus for blocking the flow of fluid from a hydraulic cylinder if the lift mechanism powered by this cylinder becomes obstructed while movement in the lowering direction is being attempted. The invention is particularly suitable for use with straddle-type automotive service hoists.

A variety of circuits are in use to control the action of hydraulic cylinders upon the occurrence of a particular event. One such circuit is shown in U. S. Letters Pat. No. 4,505,455 to include a manually actuated, two position valve for raising or lowering a pair of hydraulic cylinders connected in series. No means is provided for circuit disabling in the event the mechanism powered by one of the cylinders is obstructed. U. S. Letters Pat. No. 4,230,304 shows an arrangement to obtain equal travel of two hydraulic cylinders connected in parallel. In the event that travel becomes unequal, as may be caused by an obstruction, a valve is positioned by a pulley and cable so as to cause less fluid flow to the more positionally advanced cylinder and more flow to the other.

Another example of such a circuit is shown in U. S. Letters Pat. No. 3,960,286 and uses a double piloted, single spring biased valve to block oil flow to tilt and lift cylinders. Both the cylinders and the blocking paths of the valve are in parallel, the latter being simultaneously inserted into or removed from the flow paths. The valves are urged in one direction by the cooperative force resulting from a spring and pilot line and in the other direction by a force resulting from only a pilot signal.

Yet another example is shown in U. S. Letters Pat. No. 3,504,889 wherein the illustrated circuit uses a single valve to control two cylinders which are connected in parallel. The circuit employs pilot operated check valves and to lower the cylinders, fluid under pressure is applied to the rod end of the cylinders. As that pressure reaches a sufficiently high value, check valves are opened by pilot pressure to permit the cylinders to lower.

While these circuits have been suitable for their intended purpose, they have failed to appreciate the manner in which valves may be employed to sense differential pressure and to prevent hydraulic fluid from flowing from a cylinder if the mechanism being powered by the cylinder is obstructed. An apparatus which employs valves sensitive to differential pressure and wherein an obstructed lift mechanism is automatically disabled would be a distinct advance in the art.

SUMMARY OF THE INVENTION

In general, an apparatus for disabling an obstructed lift mechanism having at least two hydraulic cylinders for controllably lifting and lowering a load includes a pair of valves, each arranged for sensing the differential pressure between a first sensing line and a second sensing line. The first valve is movable to a position for preventing the flow of hydraulic fluid from a first cylinder when the pressure in the second sensing line exceeds that in the first sensing line by a first predetermined value. The second valve is movable to a position for preventing the flow of hydraulic fluid from the first cylinder when the pressure in the first sensing line exceeds that in the second sensing line by a second predetermined value. If the flow of hydraulic fluid from the first cylinder is prevented by the movement of either the first valve or the second valve, the operator is required to lift the load slightly to remove the obstruction.

It is an object of the invention to provide an apparatus for automatically disabling an obstructed lift mechanism which has at least two hydraulic cylinders employed for controllably lifting and lowering a load.

Another object of the invention is to provide an apparatus for disabling an obstructed lift mechanism by sensing the differential pressure between two sensing lines.

Yet another object of the invention is to provide an apparatus for disabling an obstructed lift mechanism wherein a valve is movable to a position for preventing the flow of hydraulic fluid from a cylinder when the pressure in a second sensing line exceeds that in a first sensing line by a first predetermined value.

Still another object of the present invention is to provide an apparatus for disabling an obstructed lift mechanism whereby the operator is prevented from attempting to further lower a load, being required to slightly lift it to remove the obstruction. How these and other objects are accomplished will become apparent from the detailed description of the invention taken in conjunction with the drawing.

DESCRIPTION OF THE DRAWING

FIG. 1 is a simplified side elevation view of a two-column mechanism for lifting and lowering a load, especially vehicles and the like;

DESCRIPTION OF THE PREFERRED EMBODIMENTS

Figure 1:
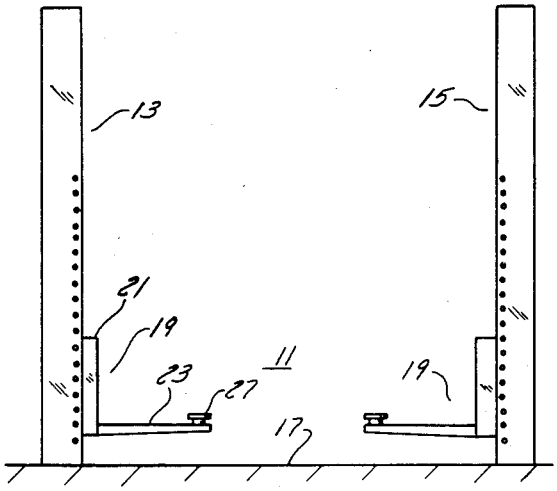

Referring first to FIGS. 1, 2, 3 and 4, the inventive apparatus 10 is shown in connection with a lift mechanism 11 as might be used for servicing the underside of automobiles and other vehicles. The mechanism 11 is shown to include first and second vertically disposed support columns, 13 and 15 respectively, which may be rigidly affixed to the floor 17 of the service area or otherwise made generally nonmovable during service work. Each column 13, 15 has slidably mounted thereon a movable carriage 19 including an attachment member 21 and a generally horizontally disposed support arm 23. Attached to the distal end 25 of the support arm 23 is a lifting platform 27 which may be configured as a simple pad or as a pair of horizontally swingable arms which are adjustable in position to suit the arrangement of the vehicle being serviced. Lift mechanisms generally of the aforedescribed type are in wide use for vehicle service. The carriage 19 of the first column 13 is vertically movable by a first hydraulic cylinder 29 while that of the second column 15 is vertically movable by a second cylinder 31.

Figure 3:
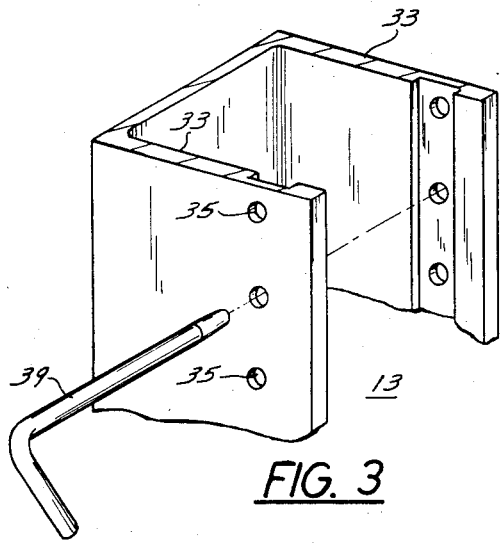
FIG. 3 is an isometric side elevation view of a column of the mechanism shown in FIGS. 1 and 2 and illustrating the manner of inserting a lock pin prior to vehicle servicing activity.
Figure 2:
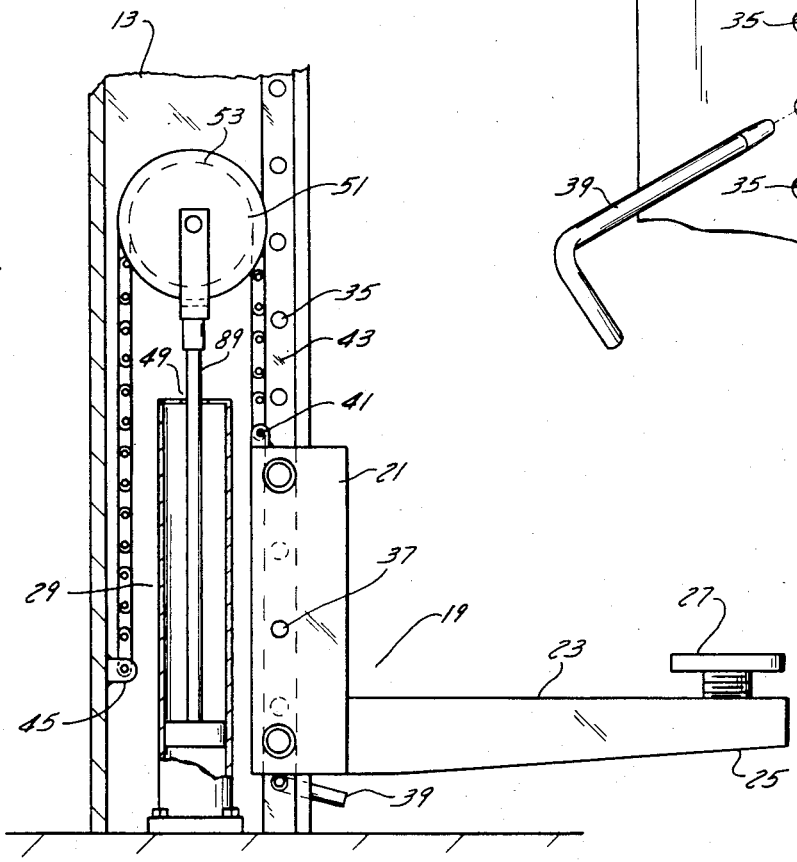
FIG. 2 is a detailed side elevation view of a part of the mechanism of FIG. 1 with portions shown in cross-section, other portions shown in full representation and yet other portions omitted for clarity.

Referring particularly to FIGS. 2 and 3, the arrangements of the columns 13, 15 are substantially identical and only that of column 13 will be described. A segment of the column 13 is generally U-shaped in cross section and has a pair of outer flanges 33, each flange 33 having a plurality of vertically arranged, regularly spaced circular apertures 35 formed therein with their cylindrical axes disposed generally horizontally and in registry opposite those of the opposing flange 33. An aperture 37 may be similarly formed in each attachment member 21 in a manner such that the operator of the mechanism may position the carriages 19 along their respective columns 13 or 15 to align the apertures 35 in the column flanges with the aperture 37 in the attachment member 21 to permit the insertion of a lock pin 39, thereby causing the carriages 19 to be supported during service and independent of the action of the hydraulic cylinders 29, 31. As best seen in FIG. 2, the attachment member 21 is connected to the first end 41 of a chain 43, the second end 45 of which is anchored to the lower frame of the lift mechanism 11. A hydraulic cylinder 29 is disposed within the lift mechanism 11, has its piston end 47 coupled to the lower frame or floor 17 and its rod end 49 coupled to a roller 51 mounted thereon for rotating movement. An arc 53 of the roller 51 engages and supports a segment of the chain 43 so that by upwardly extending the rod end 49 as shown in FIG. 2, the carriage 19 is caused to lift the supported load.

Figure 4:
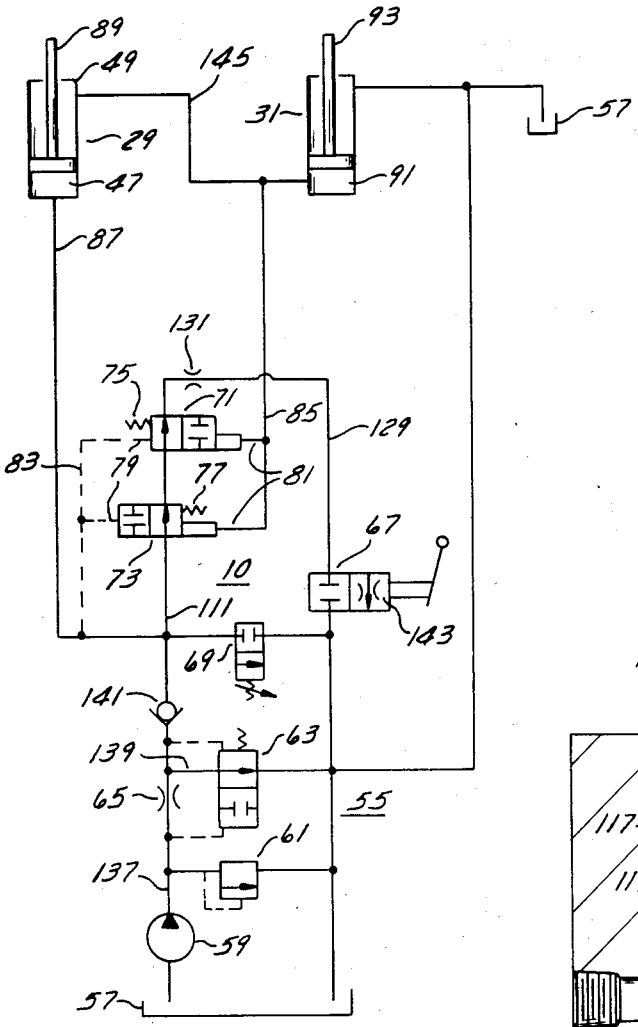
FIG. 4 is a schematic diagram of a hydraulic circuit useful with the mechanism of FIGS. 1 and 2 and incorporating the apparatus of the invention.

Referring next to FIG. 4, the apparatus 10 of the invention is shown in conjunction with a hydraulic circuit 55 useful to controllably lift and lower the carriages 19 shown in FIG. 1 and it will be apparent to those of ordinary skill that this circuit 55 is only one of many with which the novel apparatus may be used. The circuit includes a tank 57 for containing a quantity of hydraulic fluid and a source 59, such as a positive displacement pump, for delivering fluid under pressure. The source 59 may conveniently be driven by a prime mover such as an electric motor (not shown). A relief valve 61 is included for overpressure protection, while a pilot-operated bypass valve 63 permits fluid being delivered by the source 59 to be diverted to the tank 57 until the flow rate of fluid through the orifice 65 exceeds a predetermined value. The circuit 55 also includes the first column cylinder 29 and the second column cylinder 31 connected in series and a manual lowering valve 67 for permitting a vehicle to be lowered upon the completion of service. A manually operated emergency lowering valve 69 is preferably included to permit the load to be lowered in the event of a malfunction of one of the circuit components.

The inventive apparatus 10 is shown to include a first valve 71 and a second valve 73, each valve 71, 73 being of the two-position, two-way type and biased to the illustrated position by a spring 75, 77 in the absence of an appropriate differential pressure as described below. The first valve 71 and the second valve 73 each include a first pilot port 79 and a second pilot port 81 for detecting a hydraulic pressure in a first sensing line and a second sensing line, 83 and 85 respectively. The first valve 71 and the second valve 73 are each preferably constructed in a manner such that there must be a predetermined differential pressure between the pressure in the first sensing line 83 and that of the second sensing line 85 before the valve 71 or 73 may be shifted from the flow-permitting position shown to a flow-preventing position by overcoming the urging of the spring 75 or 77.

When the cylinders 29, 31 are connected as shown, the fluid present in line 87 will, at some pressure depending upon the weight and position of the vehicle being serviced, be caused to flow to the piston end 47 of the first cylinder and the rod 89 will move upwardly. This causes fluid to be expelled from the rod end 49 of the first cylinder into the piston end 91 of the second cylinder and the rod 93 of the second cylinder is thereby also caused to move upwardly and the load is lifted.

Figure 5:
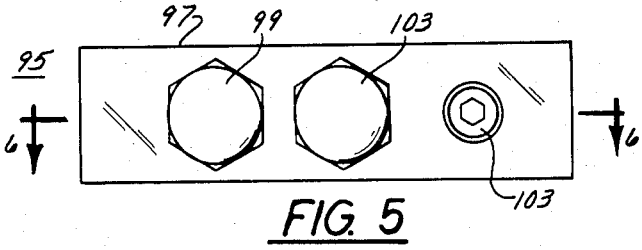
FIG. 5 is an end elevation view of a composite valve structure embodying the apparatus of the invention.

While the apparatus of FIG. 4 has been illustrated as embodying the first valve 71 and the second valve 73 as discrete components, certain economies in manufacturing and installation may result if the inventive apparatus is embodied as a composite valve 95. Referring next to FIG. 5, the composite valve 95 is shown to include a body 97 formed of a material having a strength and rigidity consistent with the pressure requirements of the application. In conventional hydraulic circuits, cast iron or machined steel are often used.

Figure 6:
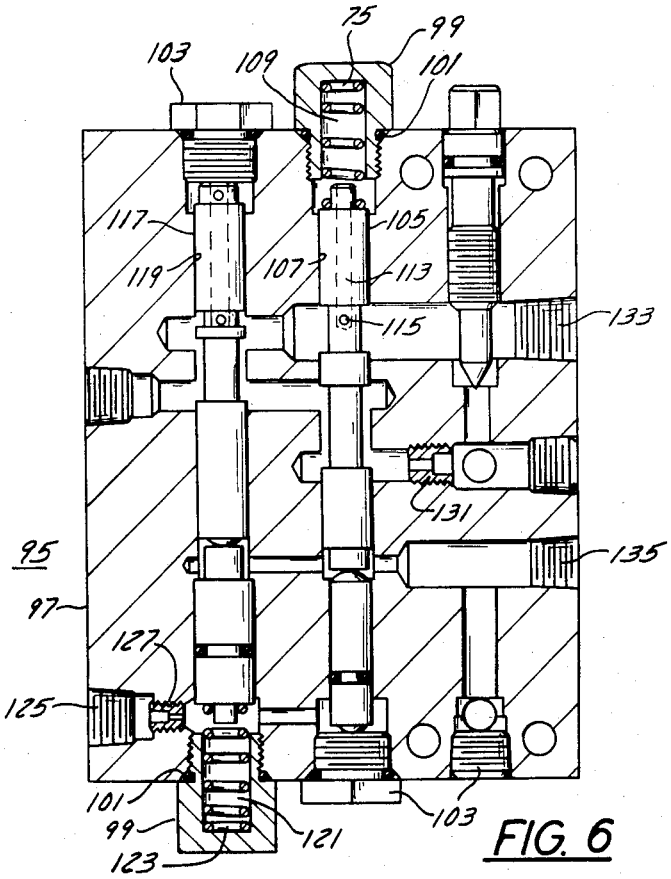
FIG. 6 is a top plan view of the valve of FIG. 5 taken along the plane 6—6 with portions shown in cross section and other portions shown in phantom.

The general techniques for making composite valves are well known and will therefore be only briefly described. Referring additionally to FIG. 6, a plurality of spring retaining caps 99 are threadably received in the body 97 and are sealed from leakage by O-rings 101. The valve 95 also includes plugs 103 for closure of construction holes subsequent to drilling and for maintaining parts within the body 97. The first valve 71 is shown to include a spool 105 sized to be in closely fitted, sliding engagement with its cylindrical bore 107 and includes a first spring chamber 109, within which is confined a biasing spring 75 which, during periods of repose, urges the spool downwardly as seen in FIG. 6. A port (not shown) is formed in the body for connecting line 111 to the valve, while a pilot passage 113 and connecting cross drilling 115 are formed in the spool 105 for providing a path by which the pressure in the first sensing line 83 may be communicated to the first pilot port 79.

Similarly, the second valve 73 also includes a spool 117 sized for closely fitted, sliding engagement with its cylindrical bore 119 and a spring chamber 121 for confining a spring 123 which, during periods of repose, urges the spool 117 upwardly as seen in FIG. 6. A cross port 125 and restrictor orifice 127 are provided for communicating that pressure at the second sensing line 85 to the second pilot ports 81 of both the first valve 71 and the second valve 73. The body 97 also includes a port (not shown) for connecting line 129 to the lowering valve 67. An orifice plug 131 is installed within the body 97 for restricting the flow rate of the fluid passing through the line 129 while threaded ports 133 and 135 are provided for connection to the piston end of the first cylinder and to the tank line respectively.

Referring again to FIG. 4 and in operation, it is assumed that the carriages 19 are lowered to floor level and that all valves 61, 63, 67, 69, 71, 73 are in the positions shown. After the vehicle is positioned above the lift platform 27, the source 59 is energized, causing hydraulic fluid to be delivered along line 137, through the orifice 65 and along line 139 to the tank. As the prime mover reaches operating speed and the delivery of the fluid from the source 59 approaches its nominal operating flow rate, the pressure drop across the orifice 65 will reach a value sufficiently high to shift the bypass valve 63 upwardly as viewed in FIG. 4, thereby blocking the flow in the line 139. The fluid is thereby diverted across the check valve 141 and since the lowering valve 67 is in the position shown, the fluid is prevented from flowing along the lines 111, 129. The fluid under pressure is therefore directed along the line 87 and into the piston end 47 of the first cylinder 29. At some value of pressure determined by the cylinder configuration, weight and position of the vehicle, the rod 89 of the first cylinder 29 will move upwardly and with it, the associated carriage 19. Initial movement causes fluid to be expelled from the rod end 49 of the first cylinder 29 and into the piston end 91 of the second cylinder 31, likewise causing a rise in pressure at that piston end 31 and upward movement of the associated carriage 19 so that the load may be uniformly lifted without substantial tilting. As the load is brought to a position for service, the apertures 37 in the attachment members 21 are aligned with apertures 35 in their respective column flanges 33, the prime mover and source 59 are de-energized and the lock pins 39 are inserted through the flange and attachment member apertures 35, 37 to support the load in the absence of hydraulic pressure.

Upon the completion of service, the prime mover and source 59 are again energized, thereby lifting the carriages 19 slightly so as to free the pins 39 of any load thereon. The prime mover and source 59 are again de-energized, the pins 39 are removed and the lowering valve 67 is then manually manipulated leftward as shown in FIG. 4. The weight of the vehicle causes fluid to be expelled from the piston end 91 of the second cylinder 31 to the rod end 49 of the first cylinder 29 and from the piston end 47 of the first cylinder 29 along the line 87, through the series-connected passages of the second valve 73 and the first valve 71 respectively, through the flow control orifice 131 and thence through the valve orifice 143 to tank 57. The vehicle is thereby controllably lowered to the floor.

The inventive apparatus 10 functions when either of the pins 39 have been inadvertently left in their load-retaining positions within the flanges 33. For example, if the lock pin 39 has been inadvertently left in the first column 13, powered by the first cylinder 29, manipulation of the valve 67 to the lowering position will permit the load to urge the rod 93 of the second cylinder 31 downwardly. The presence of orifice 143 in the lowering circuit will result in a back pressure in lines 129, 83, 87 notwithstanding that the rod 89 of cylinder 29 and its associated roller 51 and slackening chain 43 will lower of their own weight. Since the carriage 19, normally supported by cylinder 29, is prevented from moving, load tilting will result. The pressure in the first sensing line 83 will rise to exceed that in the second sensing line 85 by some second predetermined value, and the second valve 73 is thereby caused to shift rightwardly as seen in FIG. 4, thereby preventing fluid from flowing along line 111. This activity thus requires the operator to again manipulate the valve 61 to the position shown and re-energize the prime mover and source 59 to cause slight upward movement of the rod 89 of the first cylinder 29, thereby permitting removal of the pin 39. As will now be appreciated, a similar sequence of events will occur if the lock pin 39 is inadvertently left in the second column 15 except that the pressure in the second sensing line 85 will rise to exceed that in the first sensing line 83 by some first predetermined pressure, thereby causing the first valve 71 to shift leftwardly.

While the first predetermined value and the second predetermined value of differential pressure may be selected to be different one from the other, they will preferably be selected to be substantially the same one to the other. Further, it has been found that satisfactory operation will result if the displacement per unit length of stroke of the piston end 91 of the second cylinder 31 is substantially equal to that of the rod end 49 of the first cylinder 29. In this event, the valves 71, 73 may preferably be constructed to be movable to a flow-preventing position when the pressure in the first sensing line 83 or the second sensing line 85, as the case may be, is approximately 85% greater than that in the other sensing line. Those of ordinary skill in the art will recognize after appreciating the teaching of the disclosure that this pressure differential percentage or ratio may vary dramatically from that described, depending upon the relative diameters of the bores of the first and second cylinders 29, 31 and upon the relative diameters of the rods 89, 93 of those cylinders 29, 31.

The following equations and analysis will be instructive in predicting the approximate predetermined values which will cause either the first valve 71 or the second valve 73 to be shifted. As given equations F1=P1A1–P-2A2 and F2=P2A2 where F1 and F2 are the downward acting forces on rods 89 and 93 respectively, P1 and P2 are the pressures in lines 87, 145 respectively, A1 is the area of the head end of the cylinder 29 and A2 is the area of the rod end of cylinder 29 and the head end of cylinder 31. If F1 is stated to be equal to F2, then P1A1=2P2A2. Therefore, and as examples, if A1=A2 , then P1=2P2
if A1=2A2 , then P1=P2
if A1=½A2, then P1=4P2.

By way of further example, it will be assumed that the pin 39 has been inadvertently left in place in the carriage 19 associated with the first column 13 and its first cylinder 29 associated with the first column 13 and its first cylinder 29 and that the load being supported by the mechanism 11 is equally distributed between the carriages 19. Since the force F1 acting downward on rod 89 will consist merely of the weight of the rod 89, the roller 51 and chain 43, F1 will be quite low, only 5% of the value of F2, as an example. If A1=2A2, then P1A1 P2A2=0.05 P2A2. Combining terms, P1A1=1.05 P2A2, and expressing P1 in terms of P2, P1=(1.05 P2A2) divided by Al. Substituting 2A2 for A1, P1=(1.05 P2A2) divided by 2A2 which resolves to P1=(1.05 P2) divided by 2. Therefore, Pl =52.5% of P2 and defines the differential pressure in the exemplary circumstances.

Figure 7:
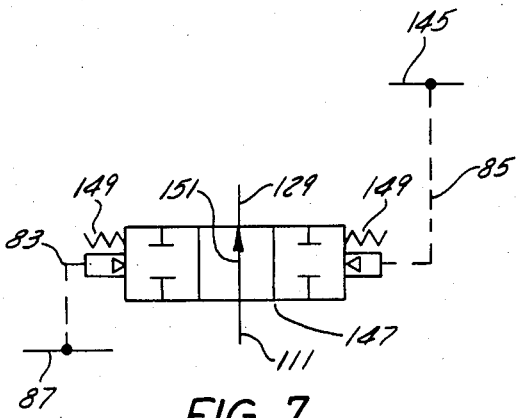
FIG. 7 is a hydraulic schematic diagram of another embodiment of the invention.

After appreciating the teaching of the disclosure, it will also be apparent to those of ordinary skill that depending upon the relative configurations of the first and second cylinders 29, 31, it may be possible to embody the inventive apparatus 10 as a pilot operated, three position, two way, spring centered valve 147 as shown in FIG. 7. A valve of this type would employ a pair of centering springs 149 and would have unequal pilot pressure areas so that the valve 147 when in its first position as shown, permits flow through the passage 151 during normal operation. If sufficient differential pressure exists between the lines 83, 85, the valve 147 will be shifted in one direction or the other to a second or third position, i.e., to one of two possible flow blocking positions. Lines 83, 85, 87, 145 illustrate how this valve 147 may be connected in the circuit of FIG. 1 in lieu of valves 71, 73.

Those of ordinary skill will also appreciate that the inherent arrangement of the disclosed mechanism will affect the magnitude of any differential pressure used to shift the valve 71 or 73. This is so since, even though a carriage 19 is obstructed from movement by a pin 39, its associated rod 89 or 93, roller 51 and chain 43 will be free to settle of their own weight, so long as the other cylinder 31 or 29 and its carriage 19 are free to be lowered. For example, if carriage 19, driven by rod 93 of cylinder 31 is so obstructed, rod 19 and its roller 51 and chain 43 will settle to the extent necessary to permit the expulsion of fluid from piston end 91 into rod end 49 so as to provide makeup fluid as rod 89 descends. In that circumstance, the pressure in line 85 will be very low, perhaps on the order of a few p.s.i.g., while that in line 87 will be of sufficient magnitude to support the load on cylinder 29.

While only a few preferred embodiments of the inventive apparatus have been shown and described, it is not intended to be limited thereby but only by the scope of the claims which follow.

I claim:

1. An apparatus for disabling an obstructed lift mechanism having at least two hydraulic cylinders employed for controllably lifting and lowering a load, said apparatus including:

a first valve for sensing the differential pressure between a first sensing line and a second sensing line;

a second valve for sensing said differential pressure between said first sensing line and said second sensing line;

said first valve being movable to a position for preventing the flow of hydraulic fluid from a first cylinder when the pressure in said second sensing line exceeds the pressure in said first sensing line by a first predetermined value;

said second valve being movable to a position for preventing the flow of hydraulic fluid from said first cylinder when the pressure in said first sensing line exceeds the pressure in said second sensing line by a second predetermined value.

2. The invention set forth in claim 1 wherein said first sensing line is connected in a pressure-sensing relationship to said first cylinder and said second sensing line is connected in a pressure-sensing relationship to said second cylinder.

3. The invention set forth in claim 2 wherein said first cylinder and said second cylinder are connected in series.

4. The invention set forth in claim 3 wherein said first predetermined value and said second predetermined value are substantially equal one to the other.

5. A hydraulic system for preventing the lowering of a mechanically obstructed lift mechanism and including:

a first cylinder having its head end connected by a first conductor to a source of pressurized fluid;

a second cylinder having its head end connected by a second conductor to the rod end of said first cylinder for permitting fluid flow therebetween;

a first valve movable between a first position for permitting fluid to flow from said first cylinder and a second position for preventing fluid from flowing from said first cylinder, said first valve including a first pilot port for sensing the hydraulic pressure in said first conductor and a second pilot port for sensing the hydraulic pressure in said second conductor;

a second valve movable between a first position for permitting fluid to flow from said first cylinder and a second position for preventing fluid from flowing from said first cylinder, said second valve including a first pilot port for sensing the hydraulic pressure in said first conductor and a second pilot port for sensing the hydraulic pressure in said second conductor;

said first valve being normally biased to said first position and piloted to said second position when said hydraulic pressure in said second conductor exceeds the pressure in said first conductor by a first predetermined value;

said second valve being normally biased to said first position and piloted to said second position when said hydraulic pressure in said first conductor exceeds the pressure in said second conductor by a second predetermined value.

6. The invention set forth in claim 5 wherein said first valve and said second valve each include a passage for permitting fluid to flow from said first cylinder and said passages are connected in a series flow relationship one with the other.

7. The invention set forth in claim 6 wherein said first predetermined value and said second predetermined value are substantially equal one to the other.

8. A hydraulic system for preventing the lowering of a mechanically obstructed lift mechanism and including:

a first cylinder having its head end connected by a first conductor to a source of pressurized fluid;

a second cylinder having its head end connected by a second conductor to the rod end of said first cylinder for permitting fluid flow therebetween;

a valve movable between a first position for permitting fluid to flow from said first cylinder and a second position for preventing fluid from flowing from said first cylinder, said valve including a first pilot port for sensing the hydraulic pressure in said first conductor and a second pilot port for sensing the hydraulic pressure in said second conductor;

said valve being further movable between said first position for permitting fluid to flow from said first cylinder and a third position for preventing fluid from flowing from said first cylinder, said valve being normally maintained at said first position and piloted to said second position or to said third position when said hydraulic pressure in one of said conductors exceeds the pressure in the other of said conductors by a predetermined value.

9. The invention set forth in claim 8 wherein said valve is of the three position, spring centered, two way type.

* * * * *